US011561073B1

(12) United States Patent
Underwood et al.

(10) Patent No.: US 11,561,073 B1
(45) Date of Patent: Jan. 24, 2023

(54) LIGHT WEIGHT AMMUNITION AND FIREARM SYSTEMS

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/323,741

(22) Filed: May 18, 2021

Related U.S. Application Data

(60) Provisional application No. 63/027,318, filed on May 19, 2020.

(51) Int. Cl.
*F42B 5/307* (2006.01)
*F41A 3/26* (2006.01)
*F41A 5/18* (2006.01)

(52) U.S. Cl.
CPC ..... *F42B 5/307* (2013.01); *F41A 3/26* (2013.01); *F41A 5/18* (2013.01)

(58) Field of Classification Search
CPC .... F42B 5/307; F42B 5/02; F42B 5/30; F42B 5/26; F42C 19/08; F42C 19/10; F42C 19/0807; F42C 19/0823; F42C 19/00
USPC ..... 102/469, 470, 204, 205
See application file for complete search history.

(56) References Cited

U.S. PATENT DOCUMENTS 3,302,523 A 2/1967 Langenhoven et al.
3,613,282 A 10/1971 Ramsay
3,650,174 A 3/1972 Nelson
3,854,400 A 12/1974 Van Langenhoven
3,859,746 A * 1/1975 Pecksen ..... F41A 19/62 102/210
5,074,189 A 12/1991 Kurtz
5,301,448 A * 4/1994 Petrick ..... F42B 5/16 42/84
5,361,702 A * 11/1994 Goetz ..... F42C 19/12 102/472
5,421,264 A * 6/1995 Petrick ..... F42B 5/08 102/443
5,755,056 A 5/1998 Danner et al.
5,996,500 A * 12/1999 Findley ..... F42B 3/14 102/472
6,237,494 B1 * 5/2001 Brunet ..... F41A 19/58 102/202.7
6,301,819 B1 10/2001 O'Dwyer
6,487,972 B1 12/2002 Cook et al.
7,059,234 B2 * 6/2006 Husseini ..... F42B 12/76 86/55
7,735,254 B2 6/2010 O'Dwyer
9,335,137 B2 5/2016 Maljkovic et al.
9,759,499 B2 9/2017 Widder et al.
10,495,425 B1 12/2019 Shebalin
10,704,876 B2 7/2020 Boss et al.
2011/0214583 A1 * 9/2011 Dutch ..... F42B 5/26 102/464

(Continued)

*Primary Examiner* — Jonathan C Weber

(57) ABSTRACT

A firearm system includes a bolt carrier with an internal cavity, a piston disposed within the internal cavity, a forward configuration where the piston is in a forwardmost position relative to the bolt carrier, and an aft configuration where the piston is in a rearmost position relative to the bolt carrier. The piston slides forward and aft relative to the bolt carrier. In the forward configuration, the entire piston remains disposed within the bolt carrier.

20 Claims, 11 Drawing Sheets

(56) References Cited

U.S. PATENT DOCUMENTS

| | | | |
|---|---|---|---|
| 2019/0011233 | A1 | 1/2019 | Boss et al. |
| 2019/0011234 | A1 | 1/2019 | Boss et al. |

* cited by examiner

LIGHT WEIGHT AMMUNITION AND FIREARM SYSTEMS

CROSS REFERENCE TO RELATED APPLICATION

This application is related to and claims priority benefit from U.S. Provisional Application No. 63/027,318 ("the '318 application"), filed on May 19, 2020 and entitled "LIGHT WEIGHT AMMUNITION AND FIREARM SYSTEMS." The '318 application is hereby incorporated in its entirety by this reference.

FIELD OF THE INVENTION

The field of the invention relates to light weight and primerless ammunition, firearm systems designed to function with light weight ammunition, and methods for manufacturing and using light weight ammunition.

BACKGROUND

Many law enforcement and military personnel carry large quantities of ammunition. Traditional metallic case ammunition is heavy, which limits the amount of ammunition that can be carried and/or limits other important supplies (e.g., firearms, medical supplies, food, water, clothing, communication equipment).

To increase safety and effectiveness of military personnel, law enforcement, and other relevant operators, it may be desirable to design new primerless ammunition and related firearm systems to minimize weight.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm system comprises: a bolt carrier comprising an internal cavity; a piston disposed within the internal cavity; a forward configuration where the piston is in a forwardmost position relative to the bolt carrier; and an aft configuration where the piston is in a rearmost position relative to the bolt carrier, wherein: the piston slides forward and aft relative to the bolt carrier; and in the forwardmost configuration, the entire piston remains disposed within the bolt carrier.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In some embodiments, a firearm system 10 is designed to function with primerless ammunition 100 and includes a system without a traditional mechanical firing pin. To ignite the explosive of the cartridge (i.e., gunpowder), the firearm system 10 may include a gas piston, a light amplification by stimulated emission of radiation (laser), piezoelectric actuator, or any other appropriate mechanism for igniting the explosive. The explosive may be gunpowder, black powder, flashpowder, smokeless powder, nitrocellulose, sulfur based materials, and/or any other flammable material.

In some embodiments, the primerless ammunition 100 includes a lightweight case 101 and does not require a primer. The lightweight case 101 weighs less than a traditional metallic case. For example, the weight of a lightweight case 101 for a 9 mm round is less than 25% of the weight of a comparable 9 mm conventional brass case. In addition, the elimination of a primer for the cartridge saves more weight. Although examples are provided specific to 9 mm ammunition, the features, concepts, and information provided herein are applicable to other calibers including handgun calibers, rifle calibers, shotgun calibers, etc. (in some cases with necessary modifications for the respective caliber). Furthermore, the embodiments may be compatible with various calibers including rifle calibers such as, for example, 5.56×45 mm NATO, 0.223 Remington, 7.62×51 mm NATO, 0.308 Winchester, 7.62×39 mm, 5.45×39 mm; pistol calibers such as, for example, 9×19 mm, 0.45 ACP, 0.40 S&W, 0.380 ACP, 10 mm Auto, 5.7×28 mm; and shotgun calibers such as, for example, 12 gauge, 20 gauge, 28 gauge, 0.410 gauge, 10 gauge, 16 gauge.

Figure 1:
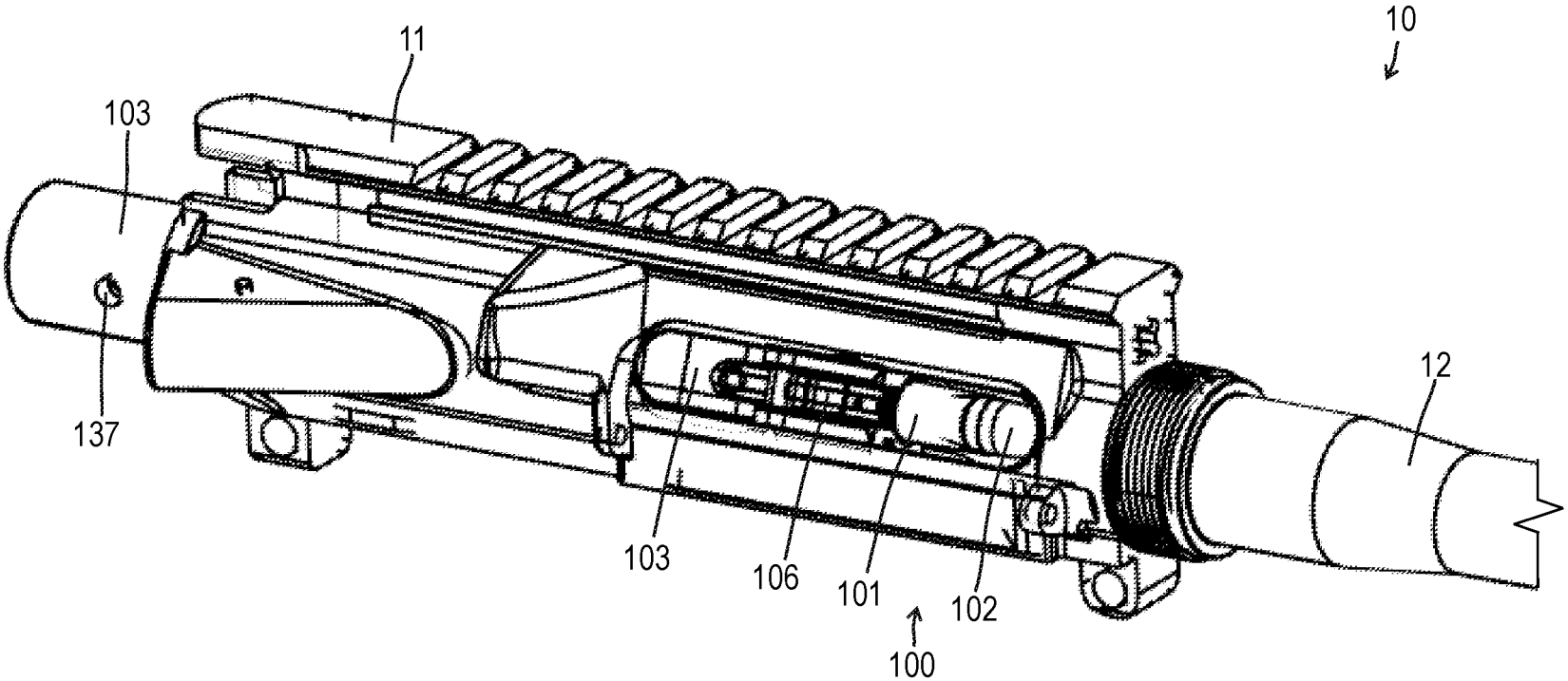
FIG. 1 is a front perspective view of a firearm system according to certain embodiments of the present invention.
Figure 2:
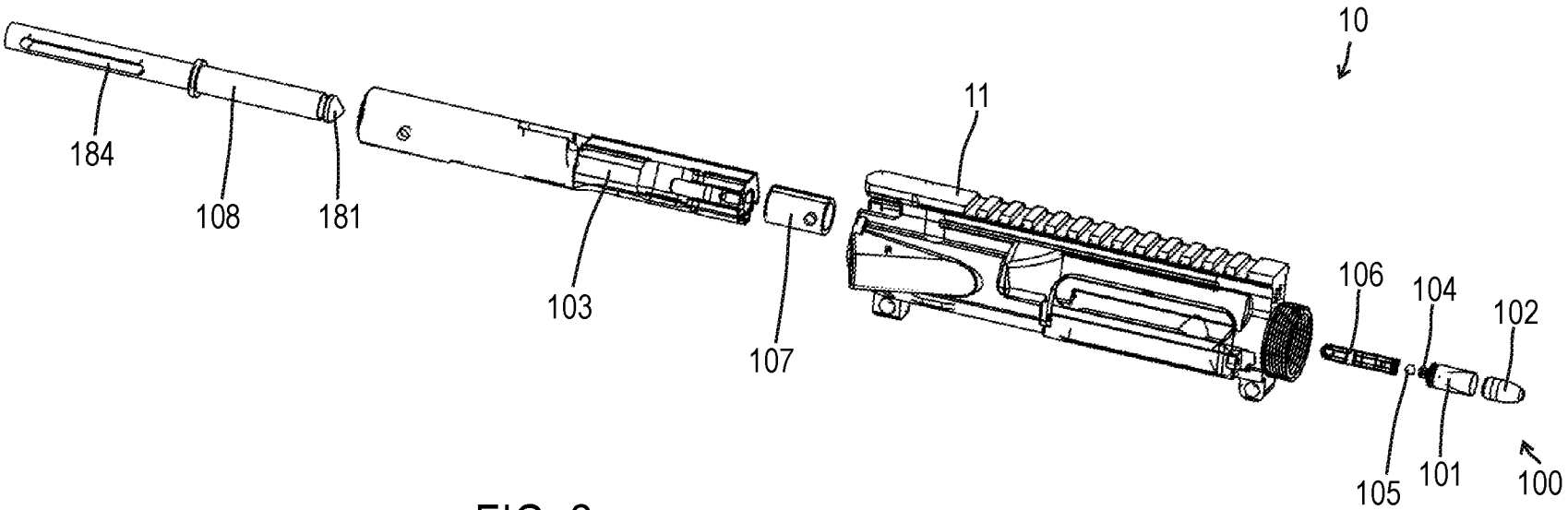
FIG. 2 is a front perspective exploded view of the firearm system of FIG. 1.
Figure 3A:
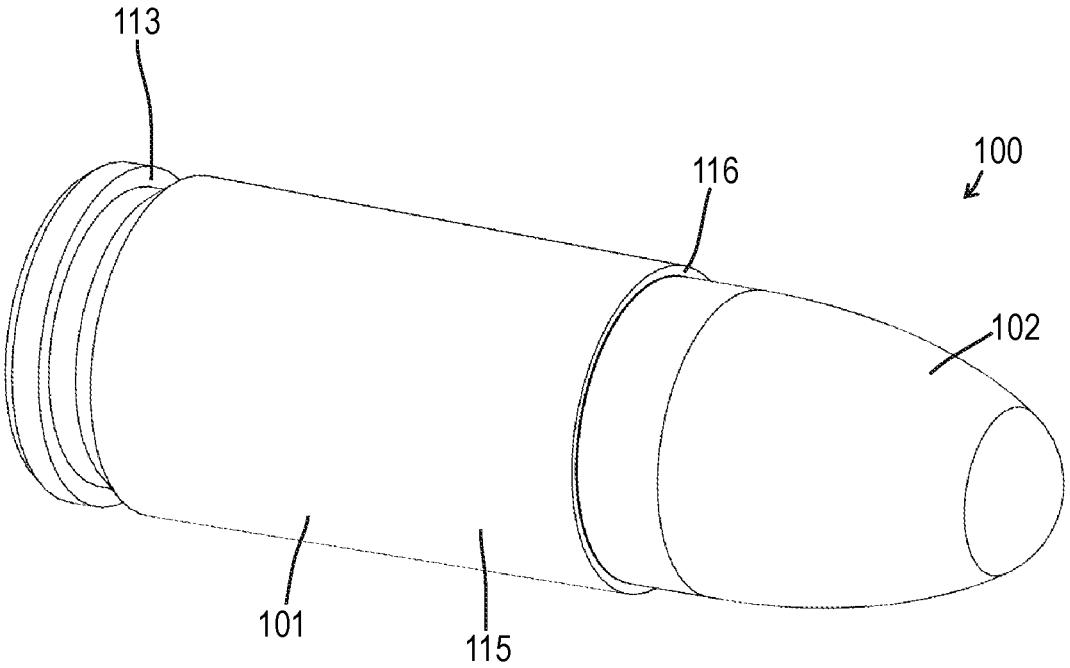
FIG. 3A is a front perspective view of primerless ammunition of the firearm system of FIG. 1.

As shown in FIGS. 1 and 2, some embodiments of a firearm system 10 include an upper receiver 11, a barrel 12, a bolt carrier 103, and an extractor 106. In some cases, the upper receiver 11 is a conventional M4 upper receiver while, in other cases, the upper receiver may be a different design. FIG. 2 is an exploded view of the firearm system 10 without the barrel 12. The bolt carrier 103 may be designed to function with primerless ammunition 100 (see FIGS. 3A-3B). In some embodiments, the bolt carrier 103 includes a front cavity 131 where the primerless ammunition 100 seats and a center hole 132 extending from the front cavity 131 into an internal cavity 135. On the right side, the bolt carrier 103 may include a recess 133 for the extractor 106 and a hole 134 for a pivot pin for the extractor 106.

Figure 3B:
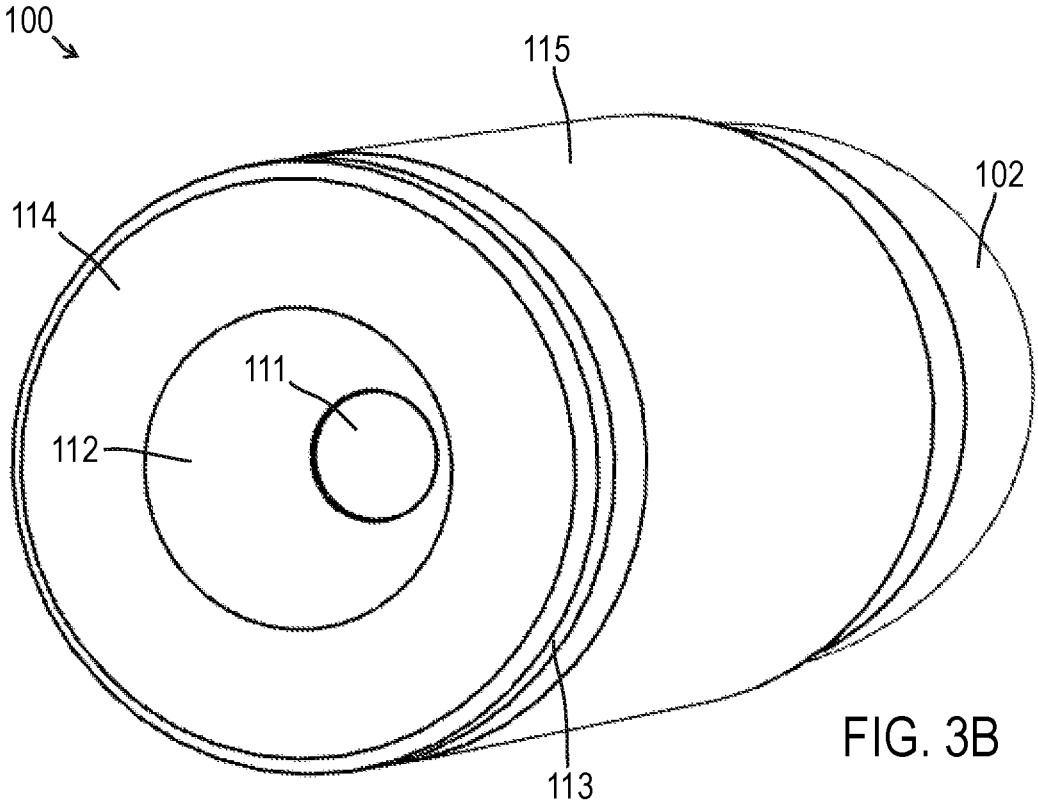
FIG. 3B is a rear perspective view of the primerless ammunition of FIG. 3A.
Figure 4A:
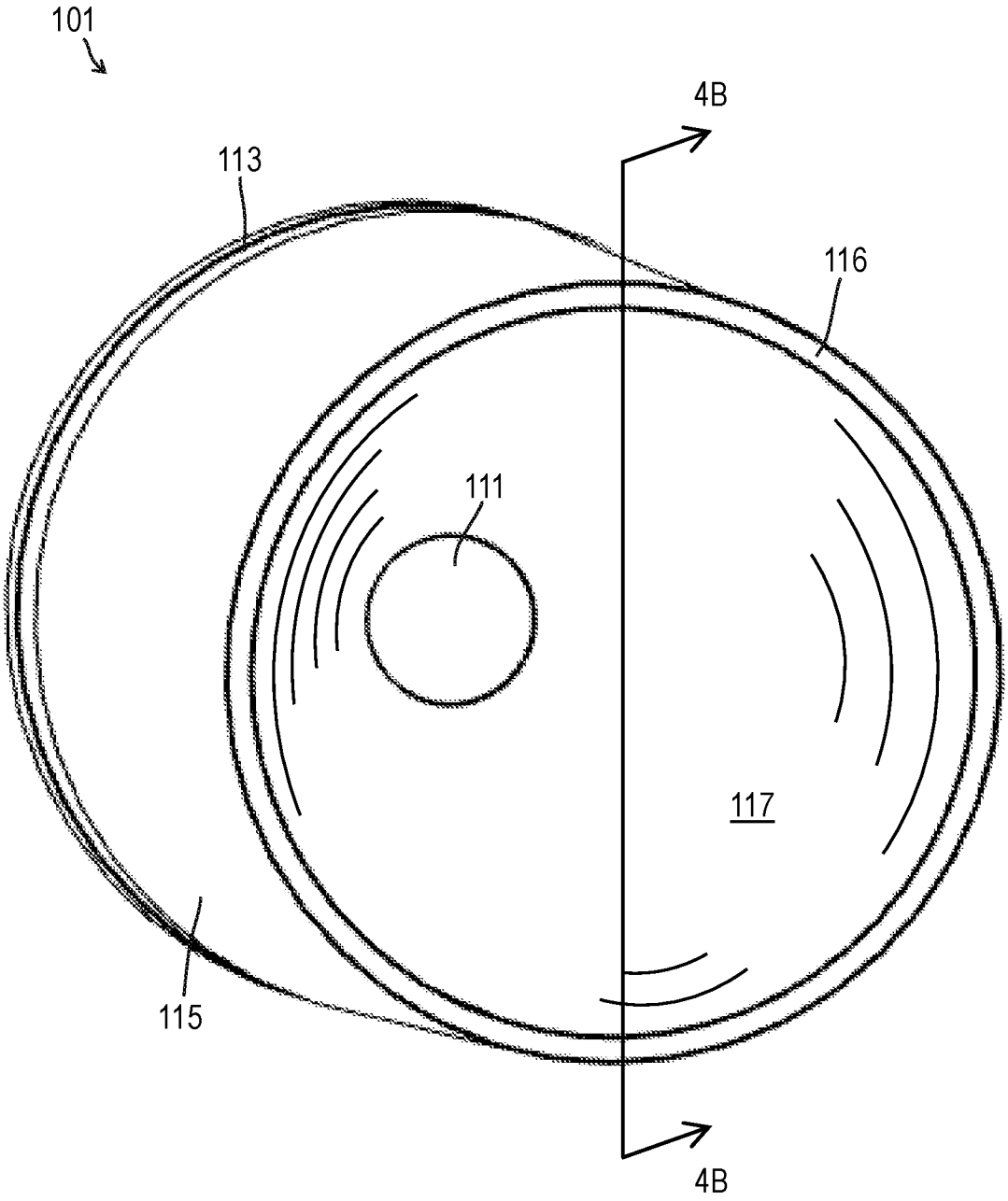
FIG. 4A is a front perspective view of a lightweight case of the primerless ammunition of FIG. 3A.
Figure 4B:
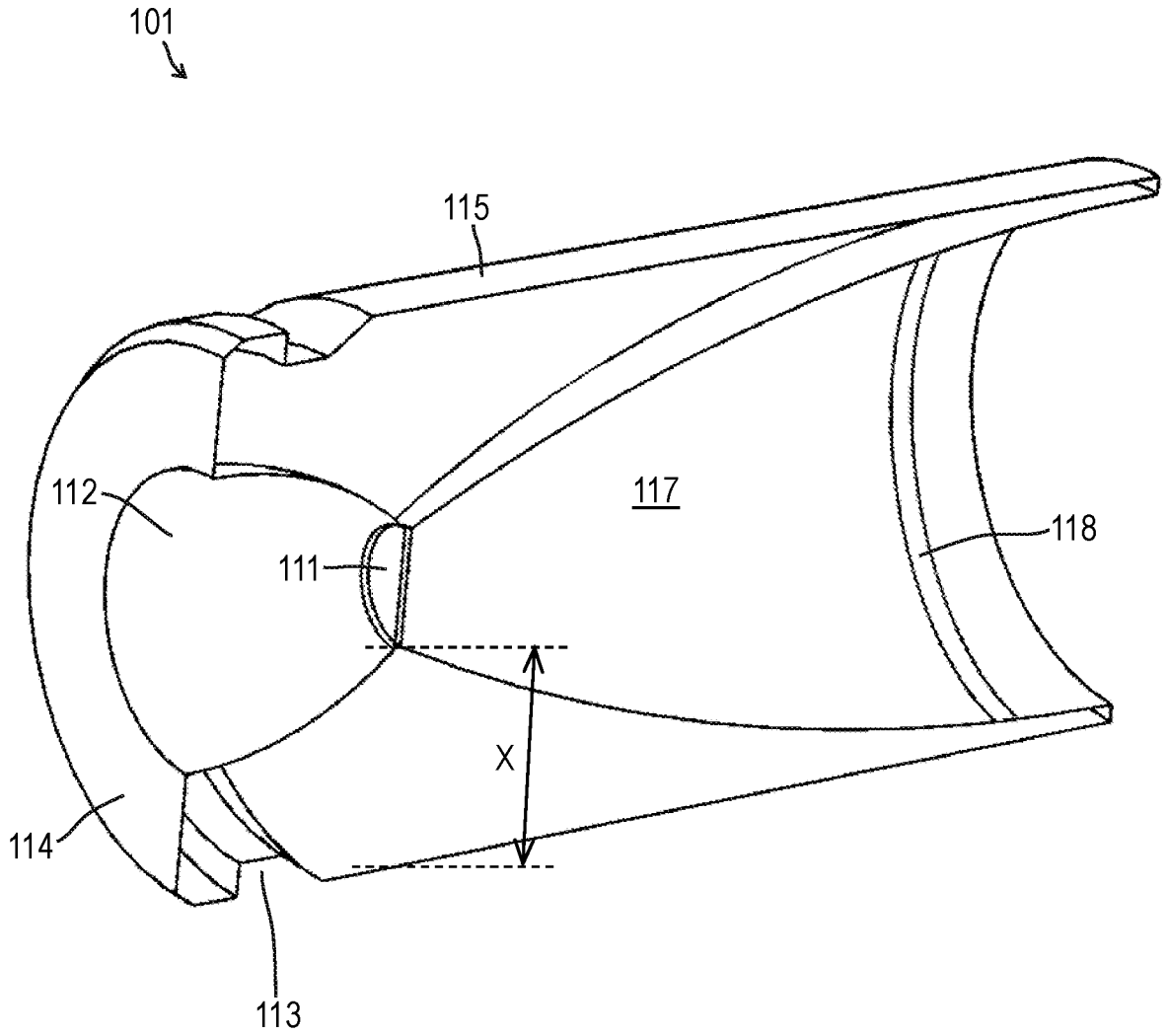
FIG. 4B is a section view of the lightweight case of FIG. 4A.
Figure 5:
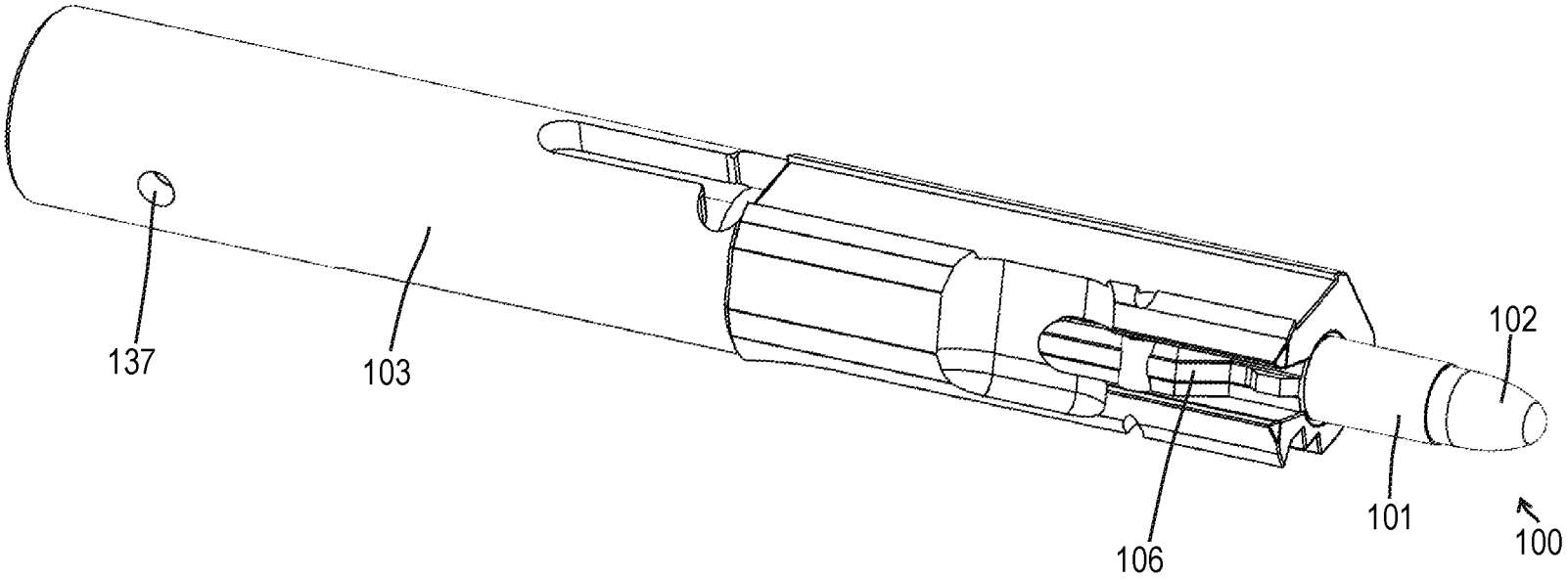
FIG. 5 is a front partial perspective view of the firearm system of FIG. 1.
Figure 6:
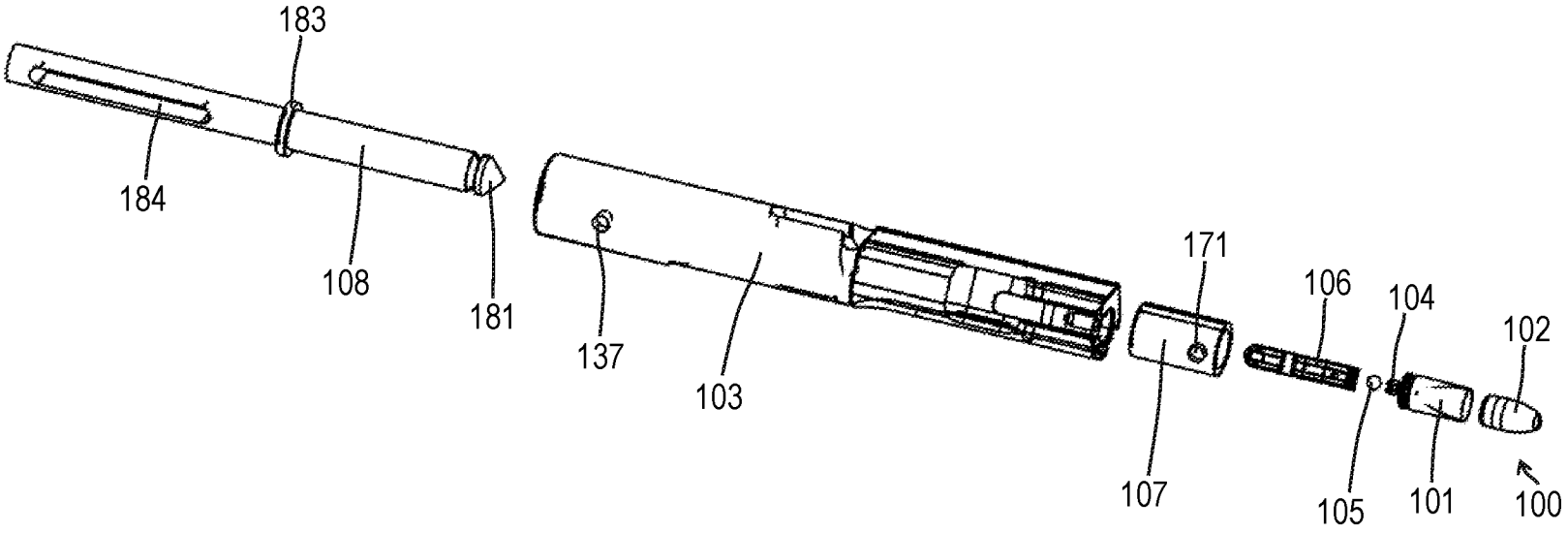
FIG. 6 is a front perspective exploded view of the firearm system of FIG. 5.

The primerless ammunition 100 may include a bullet 102 seated within a lightweight case 101. The lightweight case 101 (see FIGS. 3A-4) may include a polymer material, a composite material, a rubber material, or any other appropriate light weight material. In some embodiments, the lightweight case 101 includes a polymer material. Various components of the primerless ammunition 100 may be a polymer material including, for example, plastic, thermoplastic, nylon, polyetherimide, polyoxymethylene (acetal), polytetrafluoroethylene, polyethylene, polypropylene, polyvinyl chloride, polystyrene, carbon composite, and/or other plastic or polymer materials. In some embodiments, the lightweight case 101 includes a rear face 114 that is approximately flat, an outer surface 115 that is approximately cylindrical, a rim 113, a rear cavity 112, a forward edge 116, an internal cavity 117, and a rear membrane 111. The rear membrane 111 may be designed to be burned, broken, and/or pierced to actuate/fire the primerless ammunition 100. The rear membrane 111 may act as a diaphragm. As shown in FIG. 3B, the rear cavity 112 may be a recess in the rear face 114. In some embodiments, the rear cavity 112 is a partially conical shape such that the rear membrane 111 forms the circular flat bottom (or forward face) of the rear cavity 112. In other words, the rear cavity 112 tapers down to the rear membrane 111. In some cases, as shown in FIG. 4B, the rear cavity 112 includes the shape of a circular or elliptical paraboloid. In other embodiments, the rear cavity 112 is angular (not conical or paraboloid) and the rear membrane 111 is a polygonal (not circular) shape (e.g., triangle, rectangle, square, pentagon, hexagon, heptagon, octagon, nonagon, decagon, etc.). In some embodiments, the rear membrane 111 is approximately 0.005 in (0.127 mm) thick.

Figure 7:
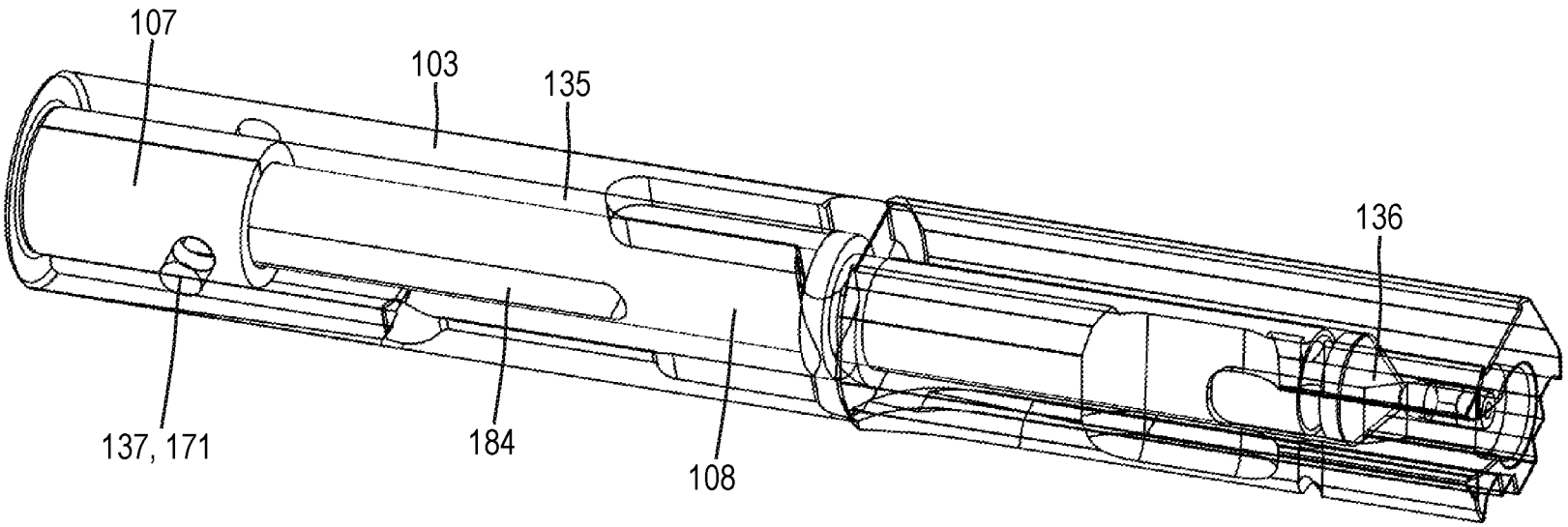
FIG. 7 is a front partial perspective view of the firearm system of FIG. 1.
Figure 8A:
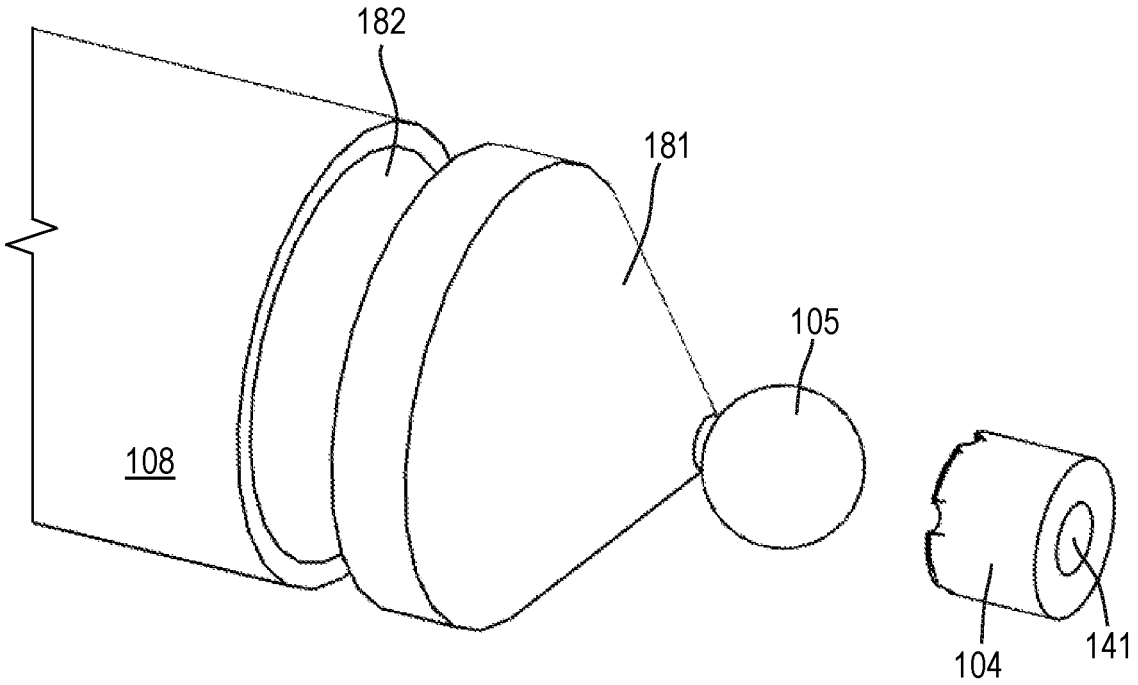
FIG. 8A is a front partial perspective view of the firearm system of FIG. 1.
Figure 8B:
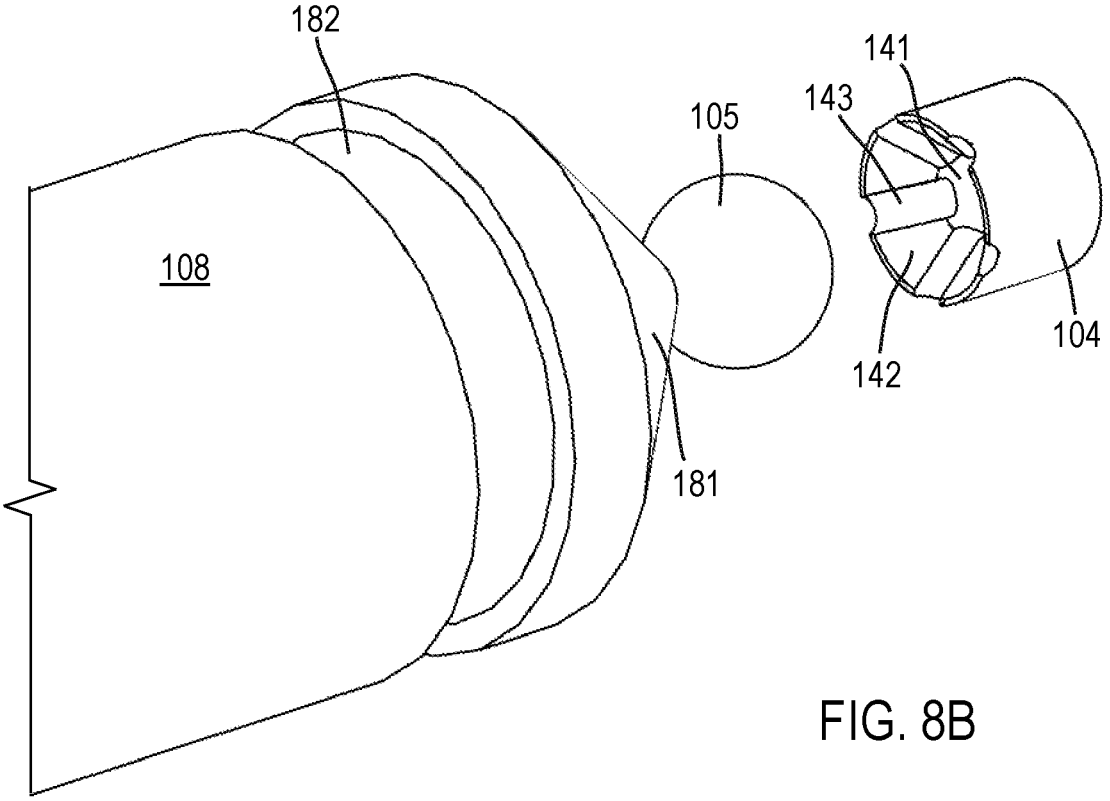
FIG. 8B is a rear partial perspective view of the firearm system of FIG. 8A.
Figure 9:
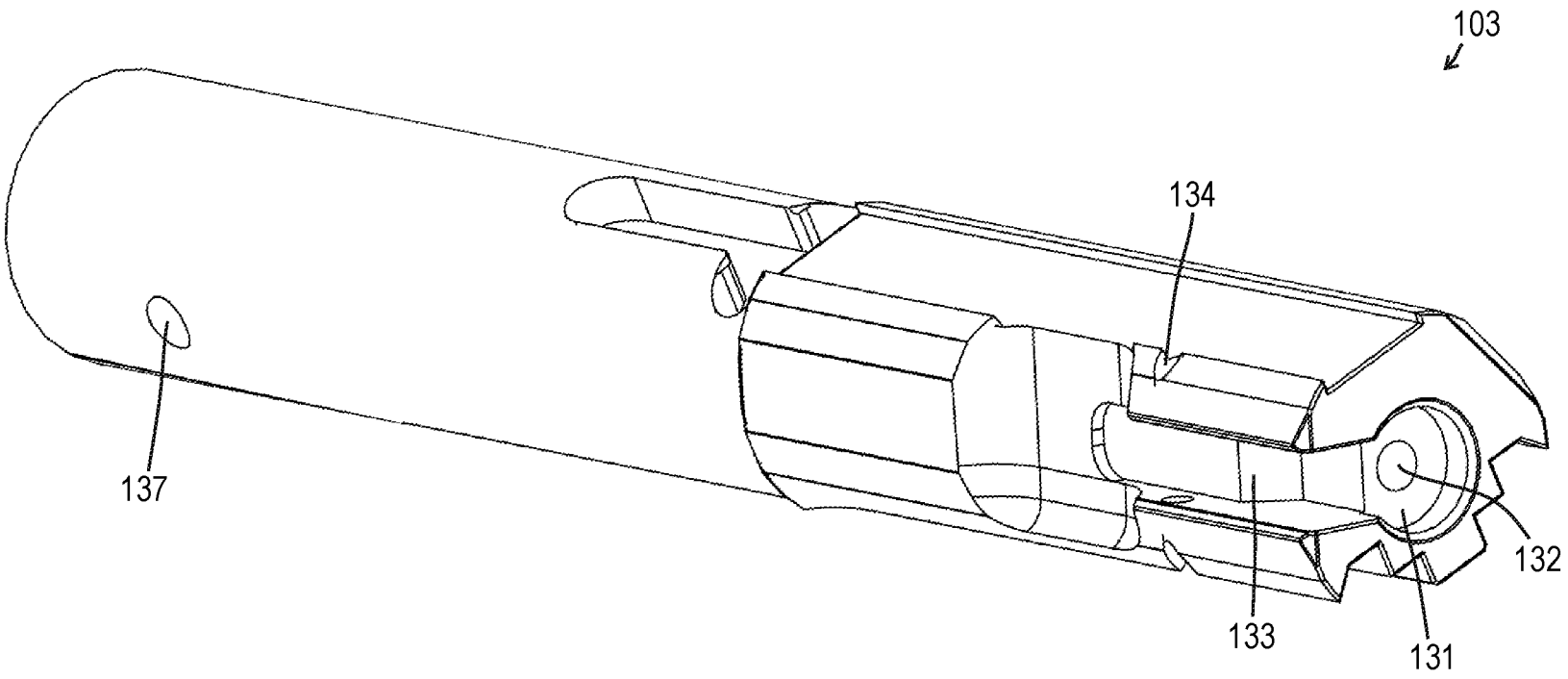
FIG. 9 is a front perspective view of a bolt carrier of the firearm system of FIG. 1.
Figure 10:
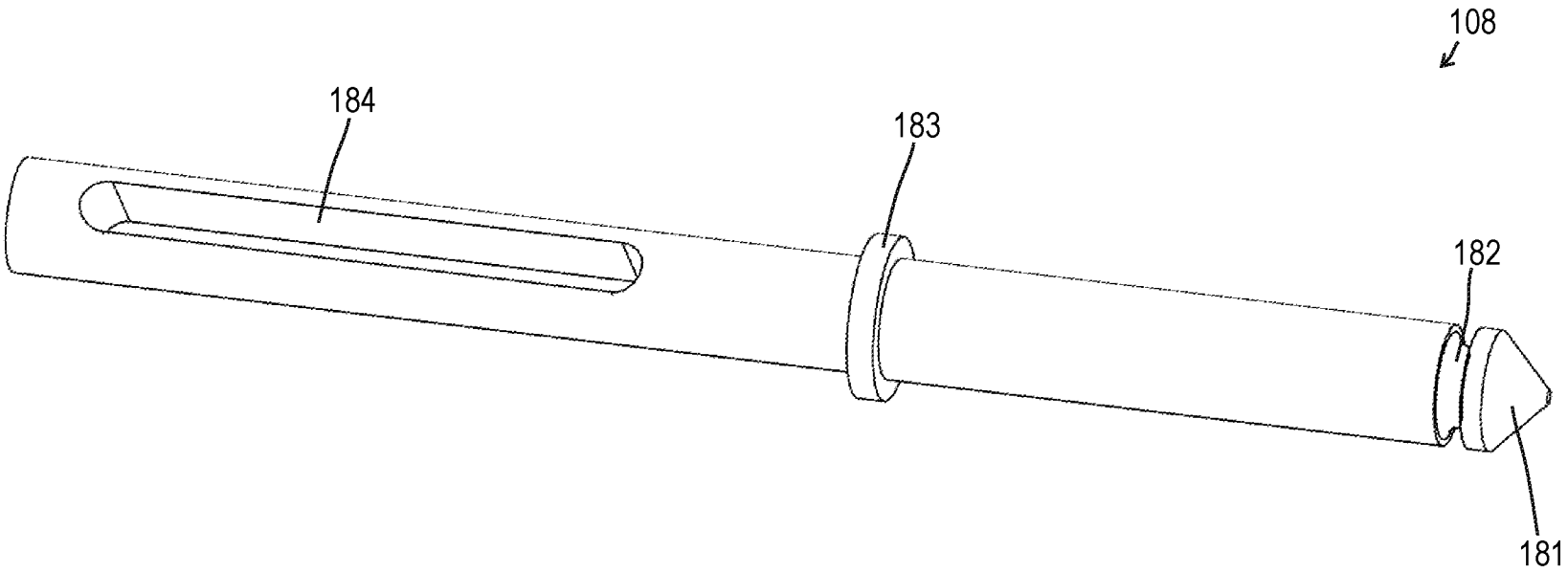
FIG. 10 is a front perspective view of a piston of the firearm system of FIG. 1.

The firearm system 10 may include a piston 108 that interfaces with an internal cavity 135 of the bolt carrier 103. In some embodiments, the internal cavity 135 includes a front conical portion 136 (see FIG. 7) that approximately matches the conical shape of the nose 181 of the piston 108 (see FIG. 10). The bolt carrier 103 is shown transparent in FIG. 7. When the piston 108 moves forward (i.e., due to trigger actuation), fluid (such as air) is compressed and pushed through the center hole 132 of the bolt carrier 103. In some embodiments, the firearm system 10 includes a valve 104 located in the center hole 132 of the bolt carrier 103. The valve 104 may be secured to the bolt carrier 103 (e.g., pinned in place). The valve 104 includes a central through hole 141 such that the compressed fluid passes through the central through hole 141 before entering the rear cavity 112 of the lightweight case 101. The force of the compressed fluid (e.g., air) is sufficient to break/pierce the rear membrane 111 and ignite the explosive of the cartridge, which is stored in the internal cavity 117 adjacent to the bullet 102. The compressed fluid may have a sufficient pressure to raise the temperature of the fluid such that the fluid burns through the rear membrane 111 ignites the explosive within the internal cavity 117. In other cases, the primerless ammunition 100 may be designed for a traditional mechanical firing pin to break/pierce the rear membrane 111 and ignite the explosive of the cartridge. The compressed fluid also causes the closing member 105 to seat within the rear recessed part 142 of the valve 104 (see FIG. 8B). When seated in the rear recessed part 142, the closing member 105 prevents and/or restricts gases from moving rearward from the chamber into the bolt carrier 103 (i.e., the gases are used to propel the bullet 102 through the barrel 12). In some embodiments, the closing member 105 is a ball. In other cases, the closing member 105 is includes a cone shape, a paraboloid shape, a pyramid shape, a cube shape, a box shape, and/or any other appropriate shape. On the rear side of the nose 181, the piston 108 may include a channel 182 (i.e., a groove 182) for securing a ring (O-ring, piston ring, etc.) where the ring prevents gases from moving rearward through the bolt carrier 103. In some cases, a small amount of gases from the explosion created by the primerless ammunition 100 passes through the valve 104 filling the cavity (i.e., located forward of the ring in the channel 182) thus causing the closing member 105 to seat within the rear recessed part 142 of the valve 104.

The lightweight case 101 may include a non-metallic material including, for example, a polymer. To ensure sufficient strength and to avoid rupture/failure of the lightweight case 101, the lightweight case 101 may include a wall thickness X that extends to the edge of the rear membrane 111 as shown in FIG. 4B. Based on the wall thickness X, at a cross section located at the rear membrane 111, the lightweight case 101 may include a total wall thickness that is approximately 60% to 90% of the total diameter of the lightweight case 101. In some cases, the total wall thickness is approximately 70% to 80% of the total diameter of the lightweight case 101. In some cases, the total wall thickness is approximately 75% to 80% of the total diameter of the lightweight case 101. In some embodiments, the total wall thickness is approximately 75% of the total diameter of the lightweight case 101. In some embodiments, the total wall thickness is approximately 80% of the total diameter of the lightweight case 101.

As described above, the valve 104 may be locked in position relative to the bolt carrier 103 or may be free (or constrained with a limited window) to move relative to the bolt carrier 103. In some cases, the outer shape of the valve 104 is cylindrical, conical, a paraboloid, and/or any other appropriate shape. The rear recessed part 142 of the valve 104 may include at least one groove 143 designed to allow a controlled amount of gases to move through or around the interface between the valve 104 and the closing member 105. The shape of the rear recessed part 142 may be conical, circular or elliptical paraboloid, angular, and/or any other appropriate shape.

The propellent gases described above that vent toward the front of the piston 108 from the primerless ammunition 100 are also sufficient to propel the piston 108 and the bolt carrier 103 rearward such that the empty lightweight case 101 is propelled out of the firearm system 10 by the extractor 106 and a subsequent round of primerless ammunition 100 is stripped from a magazine (not shown). Dissipation of the rearward movement and control of the subsequent forward movement of the piston 108 relative to the bolt carrier 103 is based on a spring that extends between (i) a rear side of the protrusion 183 of the piston 108 and (ii) a forward side of sleeve 107. The sleeve 107 is attached with a pin that passes through (i) hole 137 of the bolt carrier 103, (ii) hole 171 of the sleeve 107, and (iii) slot 184 of the piston 108. When the piston 108 moves relative to the bolt carrier 103 (rearward and forward), the pin slides within the slot 184.

In some embodiments, the piston 108 moves between a forward configuration where the piston 108 is in a forwardmost position relative to the bolt carrier 103, and an aft configuration where the piston 108 is in a rearmost position relative to the bolt carrier 103. In the forward configuration, the nose 181 of the piston 108 approaches and/or reaches the front conical portion 136 of the internal cavity 135 of the bolt carrier 103. No portion of the piston 108 protrudes out of or extends through the bolt carrier 103 (in any configuration). Conventional firearms typical include a firing pin that (when actuated) protrudes out of the front of the bolt carrier group. In the aft configuration, the piston 108 moves away from the conical portion 136 of the internal cavity 135 of the bolt carrier 103 and compresses the spring on the rear side of the protrusion 183 of the piston 108.

As shown in FIG. 4B, the internal cavity 117 may include the shape of a circular or elliptical paraboloid. The shape of the lightweight case 101 is designed such that all areas between the internal cavity 117 and the rear cavity 112 include thick walls except for the rear membrane 111. This structure ensures that the compressed fluid pushed forward by the piston 108 creates an expected and predictable failure at the membrane 111.

In some embodiments, the membrane 111 is a removable or replaceable component that can installed after the other portions of the primerless ammunition 100 are manufactured. For example, the lightweight case 101 may be overmolded or co-molded with the bullet 102 in a single manufacturing process. In other embodiments, the lightweight case 101 may include a mechanical feature 118 to engage and secure the bullet 102. The mechanical feature 118 may be an annular protrusion (e.g., as shown in FIG. 4B). In some cases, the mechanical feature 118 engages a corresponding feature in the bullet 102 (e.g., a groove). In other cases, the lightweight case 101 and the bullet 102 may be bonded, attached, and/or sealed to one another using adhesive or other chemical fasteners. These options for attachment between the lightweight case 101 and the bullet 102 are compatible with the membrane 111 whether it is replaceable or not. The explosive could then be inserted into the internal cavity 117 through the opening before the membrane is installed. The membrane 111 can be installed at the interface between the internal cavity 117 and the rear cavity 112. As shown in FIGS. 3B-4B, the membrane 111 may have a disc (or cylindrical) shape. In other embodiments, the membrane 111 may have a cone shape, a paraboloid shape, a pyramid shape, a cube shape, a box shape, and/or any other appropriate shape. In some embodiments, the membrane 111 is designed to be a movable component that acts as a valve (e.g., a one-way valve) to restrict flow of propellant gases from the internal cavity 117 toward the rear cavity 112. In other words, the membrane 111 may be designed to ensure the propellant gases impart energy to the bullet 102.

The components of any of the firearm systems 10 described herein may be formed of materials including, but not limited to, plastic, thermoplastic, nylon, polyetherimide, polyoxymethylene (acetal), polytetrafluoroethylene, polyethylene, polypropylene, polyvinyl chloride, polystyrene, carbon composite, other plastic or polymer materials, steel, aluminum, stainless steel, high strength aluminum alloy, titanium, magnesium, other metallic materials, other composite materials, or other similar materials. Moreover, the components may be attached to one another via suitable fasteners, which include, but are not limited to, screws, bolts, rivets, welds, over molding, injection molding, epoxy, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A primerless ammunition comprising:

a lightweight case comprising a rear face, a rear cavity recessed from the rear face, and an internal cavity;

a bullet disposed at least partially within the internal cavity, wherein:

the rear cavity remains open to a rear side and empty;

the rear cavity tapers down to a rear membrane that separates the rear cavity from the internal cavity such that the rear membrane is thinner than other portions of the lightweight case; and the rear membrane is a continuous barrier between the rear cavity and the internal cavity.

2. The primerless ammunition of claim 1, wherein the lightweight case comprises a polymer material.

3. The primerless ammunition of claim 1, wherein the rear cavity comprises at least one selected from the group of a paraboloid or a conical shape.

4. The primerless ammunition of claim 1, wherein the internal cavity comprises at least one selected from the group of a paraboloid or a conical shape.

5. The primerless ammunition of claim 1, further comprising a flammable material within the internal cavity.

6. The primerless ammunition of claim 1, wherein the rear membrane is designed to be burned by a stream of fluid such that the stream of fluid would ignite a flammable material within the internal cavity.

7. The primerless ammunition of claim 1, wherein the rear membrane is designed to be pierced by a stream of fluid such that the stream of fluid would ignite a flammable material within the internal cavity.

8. The primerless ammunition of claim 1, wherein the lightweight case is overmolded onto the bullet.

9. The primerless ammunition of claim 1, wherein the lightweight case comprises a portion where the total wall thickness is approximately 70% to 80% of the total diameter of the lightweight case.

10. The primerless ammunition of claim 1, wherein the rear membrane is approximately 0.005 in thick.

11. The primerless ammunition of claim 1, wherein the rear cavity comprises a circular opening at the rear face and tapers down to a smaller circular shape at the rear membrane.

12. A primerless ammunition comprising:

a case, the case comprising:

a rear face;

a rear cavity disposed at the rear face;

an internal cavity; and a rear membrane that acts as a barrier between the rear cavity and the internal cavity, wherein:

the rear cavity remains open to a rear side and empty; and the rear membrane is a continuous barrier between the rear cavity and the internal cavity.

13. The primerless ammunition of claim 12, wherein the rear membrane is thinner than all other portions of the case.

14. The primerless ammunition of claim 12, wherein the case comprises a polymer material.

15. The primerless ammunition of claim 12, wherein the rear cavity comprises a circular opening at the rear face and tapers down to a smaller circular shape at the rear membrane.

16. The primerless ammunition of claim 12, wherein the rear membrane is designed to be pierced by a stream of fluid such that the stream of fluid would ignite a flammable material within the internal cavity.

17. The primerless ammunition of claim 12, wherein the case is overmolded onto a bullet.

18. The primerless ammunition of claim 12, wherein the rear cavity tapers down to a first diameter at the rear membrane and the internal cavity tapers down to the same first diameter at the rear membrane.

19. The primerless ammunition of claim 12, wherein the rear membrane is approximately 0.005 in thick.

20. The primerless ammunition of claim 12, wherein the rear cavity and the internal cavity each comprises at least one selected from the group of a paraboloid or a conical shape.

* * * * *